United States Patent [19]

Peters

[11] Patent Number: 4,709,458

[45] Date of Patent: Dec. 1, 1987

[54] FASTENING OVERLAYING SHEETS BY PUNCH AND DIE APPARATUS

[76] Inventor: Mark C. Peters, 1357 Meadowcreek, Pewaukee, Wis. 53072

[21] Appl. No.: 786,680

[22] Filed: Oct. 11, 1985

[51] Int. Cl.[4] ..... B23P 11/00

[52] U.S. Cl. ..... 29/243.5

[58] Field of Search ..... 29/21.1, 566, 432, 243.5; 72/325

[56] References Cited

U.S. PATENT DOCUMENTS

| | | | |
|---|---|---|---|
| 2,288,308 | 6/1942 | Williams | 29/21.1 |
| 2,619,855 | 12/1952 | Williams | 29/21.1 |
| 2,671,361 | 3/1954 | Sandberg | 29/21.1 |
| 2,865,451 | 12/1958 | Ihrig | 29/21.1 |
| 3,470,596 | 10/1969 | Belada | 29/21.1 |
| 3,599,318 | 8/1971 | Behlen | 29/21.1 |
| 3,900,937 | 8/1975 | Schleicher | 29/21.1 |
| 3,934,327 | 1/1976 | Hafner | 29/21.1 |
| 4,035,901 | 7/1977 | Lux et al. | 29/243.5 |

FOREIGN PATENT DOCUMENTS

| | | | |
|---|---|---|---|
| 2124954 | 2/1984 | United Kingdom | 72/325 |

*Primary Examiner*—Robert C. Watson

*Attorney, Agent, or Firm*—Ronald E. Barry

[57] ABSTRACT

A punch and die assembly for forming a spot clinch joint between two or more laminated sheets, the assembly including a frame having a die cartridge and a punch cartridge mounted thereon, the die cartridge including a housing having a slitting and forming slot, a moveable die block forming one side of the slot, an anvil positioned in the housing and projecting into the slitting and forming slot, a spring for biasing the anvil into the slot and an adjustable screw assembly for limiting the motion of the anvil to correspond to the thickness of the laminated material; the punch cartridge including a housing having a punch mounted therein for reciprocal motion toward and away from the anvil; and a power source mounted on the frame and being operatively connected to move the punch through a continuous cycle of motion whereby a spot clinch joint will be formed on one side of the anvil in the laminated sheet material when placed in the space between the anvil cartridge and punch cartridge in each cycle of motion of the punch.

17 Claims, 11 Drawing Figures

FASTENING OVERLAYING SHEETS BY PUNCH AND DIE APPARATUS

BACKGROUND OF THE INVENTION

Fastening overlying sheets by partially piercing and deforming sections of the sheets is a fairly common practice generally referred to as spot clinching. This method has been successfully employed for many years since it eliminates the need for a separate fastener and is adequate for sheet metal joints used in joining ducts or the like. The technique is fairly simple in that it only requires that a section of the sheets be punched or pierced and subsequently deformed to lock the sheets together. Normally this has been achieved in a two-punch system wherein the sheets are pierced at the first step and the pierced section swaged at the second step. Where piercing and swaging have been accomplished by a single punch, the punch and/or die is moved in a sequence of steps to complete the operation. This involves the use of a linkage system to provide the different punching motions and to strip the pierced section from the die.

SUMMARY OF THE INVENTION

The punch and die apparatus of the present invention accomplishes the piercing and swaging steps in a single motion of the punch. The punch is moved in a continuous stroke to pierce and deform the material into a slot in the die. An anvil moves with the punched material through a preset portion of the piercing portion of the stroke and then stops. In the final movement of the punch the pierced material is swaged and the anvil moves laterally in order to lock the swaged material under the edge of the bottom sheet of material. As the punch is withdrawn, the anvil strips the deformed material from the die.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
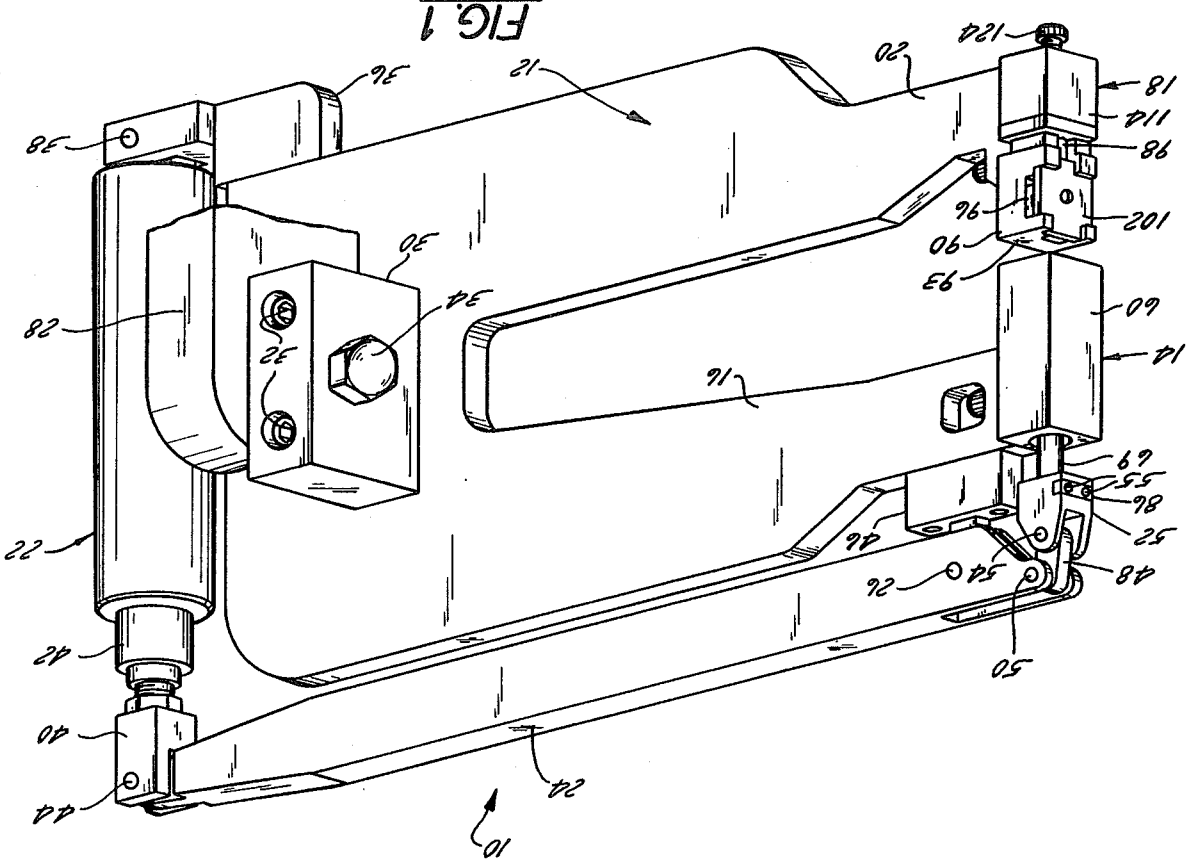
FIG. 1 is a perspective view of the punch and die apparatus according to the present invention.
Figure 4:
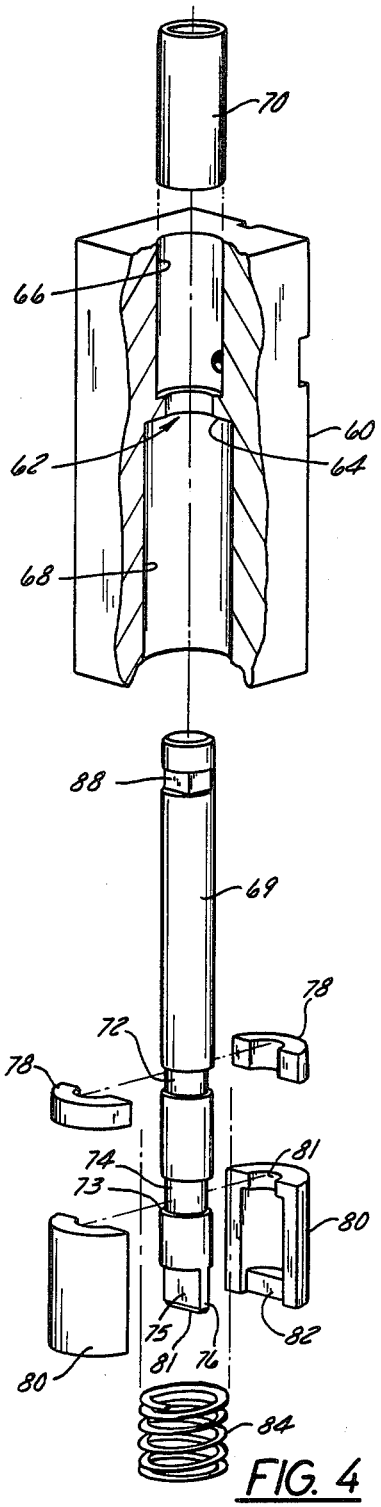
FIG. 4 is an exploded perspective view of the punch cartridge.
Figure 2:
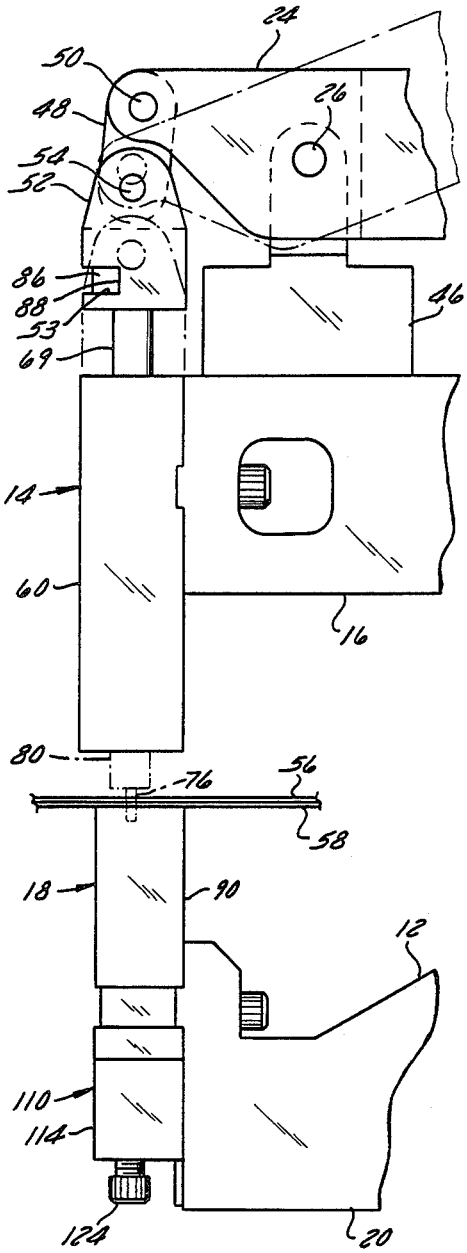
FIG. 2 is a side view of a portion of the apparatus showing the arrangement of the punch cartridge and the die cartridge.

Referring to FIGS. 1 and 2, the spot clinch apparatus 10 generally includes a C-frame 12 having a punch cartridge 14 mounted on the upper portion 16 of the frame 12 and a die cartridge 18 mounted on the lower portion 20 of the frame 12. The punch cartridge 14 is actuated by means of an air cylinder 22 mounted on the end of the frame 12 and connected to the punch cartridge by means of a pivot arm 24. Actuation of the air cylinder 22 will pivot the arm 24 about pivot pin 26 to cycle the punch cartridge and die cartridge through one cycle of operation.

The frame 12 is supported on a fixed stand 28 by means of a support block 30 secured to the side of the frame by bolts 32. The support being connected to the stand 28 by a bolt 34. The air cylinder 22 is supported on a pivot block 36 by means of a pivot pin 38 and is connected to one end of the pivot arm 24 by means of a clevis 40 secured to the end of a piston rod 42 and pivotally connected to the pivot arm 24 by a pin 44. The pivot arm 24 is pivotally supported on a pivot block 46, which is secured to the upper portion 16 of the frame 12, by means of the pin 26. The pivot arm 24 is connected to the punch cartridge 14 by means of a link 48 having one end connected to the pivot arm 24 by means of a pin 50 and the other end connected to a clevis 52 by means of a pin 54.

The material to be fastened together is in the form of two thin sheets 56 and 58 which are shown positioned between the punch cartridge 14 and the die cartridge 18 in FIG. 2. On actuation of the air cylinder 22, the pivot arm 24 will pivot about the pin 26 as seen in FIG. 2, cycling the punch cartridge 14 to pierce and swage a portion of the two sheets or more sheets into the die cartridge 18.

Punch Cartridge

Figure 3:
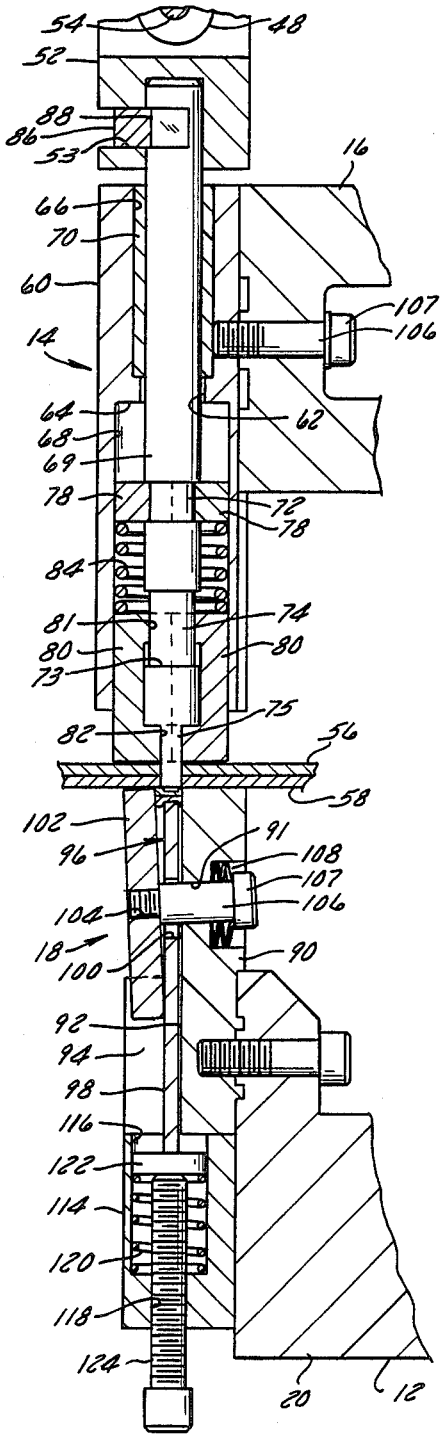
FIG. 3 is a side elevation view in section showing the punch cartridge and die cartridge with the punch shown at the end of the working stroke.

The punch cartridge 14 as shown in FIG. 3 includes a punch body or housing 60 having an axially extending bore 62 separated by means of a shoulder 64 into an upper bore 66 and a lower bore 68. A cylindrical punch member 69 is mounted for axial movement in the bore 62. The punch member 69 is guided for axial movement in the bore 62 by means of a cylindrical bearing 70 seated on the shoulder 64 in the upper bore 66. The punch member 69 is provided with a slot 88 at the upper end, a first reduced diameter section 72, and a second reduced diameter section 74 intermediate the ends of the punch 69. A punch 76 having flat faces 75 is provided at the lower end of the member 69. A split spring retainer 78 is mounted on the first reduced diameter section 72 and is retained thereon by the lower bore 68.

Means are provided on the punch member 69 to strip the sheets from the punch 76. Such means is in the form of a split cylindrical stripper member 80 having an upper retainer section 81 and a lower stripper section 82. The member 80 is mounted on the punch member 69 with the section 81 seated in the second reduced diameter section 74 and the lower stripper section 82 positioned to engage the opposite flat faces 75 of the punch 76. The stripper member 80 is retained on the punch member 69 by the close fit in bore 68. The member 80 is biased into engagement with the shoulder 73 at the lower end of section 74 by means of a spring 84 located between the spring retainer 78 and the upper end of the member 80. In the fully retracted position, the flat end 77 of the punch 76 should be aligned with the lower edge of the stripper section 82. It should be noted that the corners 79 of the punch 76 are cut off at an angle of approximately 45 degrees and the edges 83 of the sides of the punch 76 are cut at an angle of approximately 15 degrees. The upper end of the punch 69 is connected to the clevis 52 by means of a retainer block 86 positioned in groove 53 in the clevis 52 and retained therein by the screws 55. The retainer block 86 is aligned with the slot 88 provided in the upper end of the punch 69.

Die Cartridge

Figure 5:
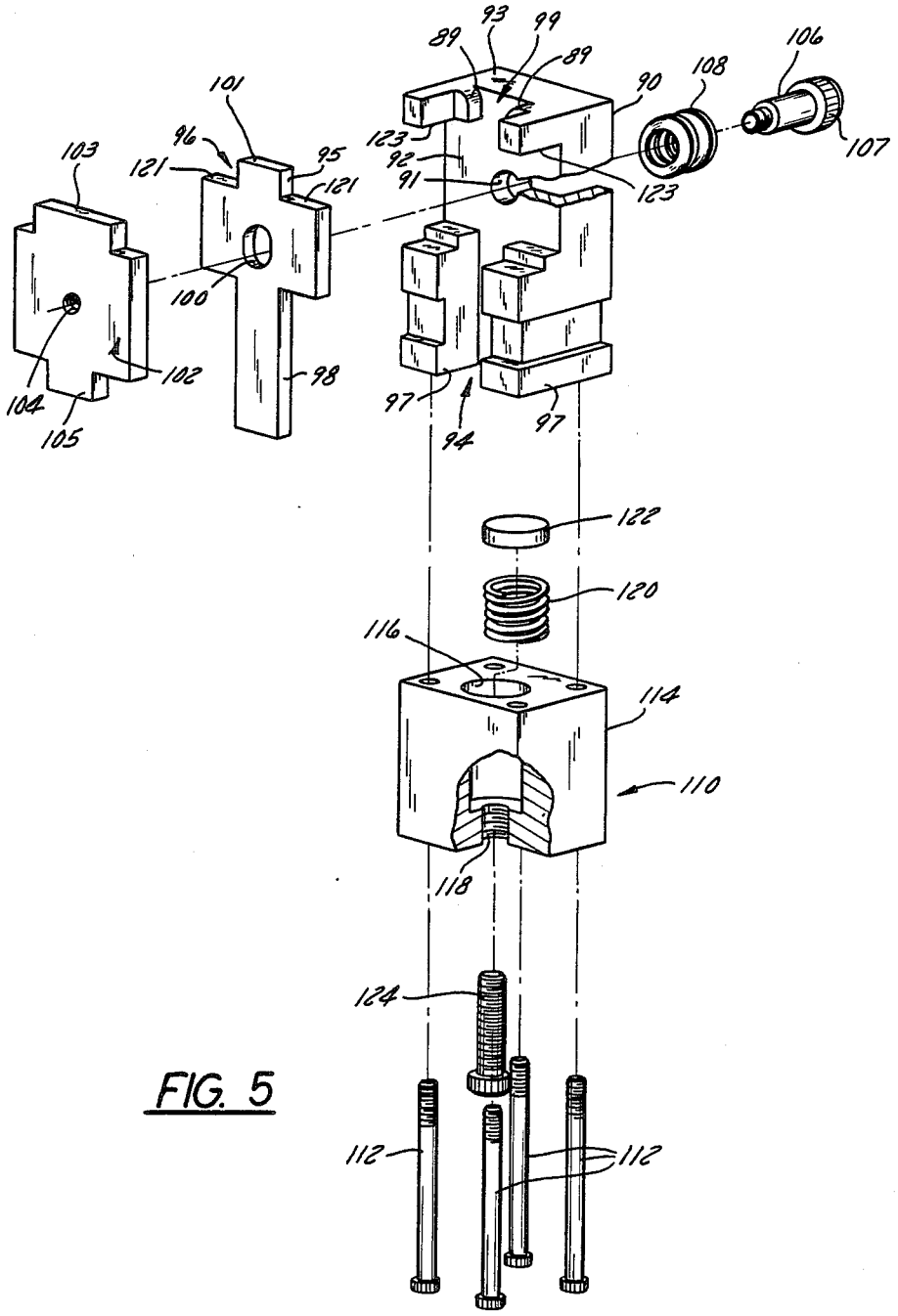
FIG. 5 is an exploded perspective view of the die cartridge.

The die cartridge 18, as seen in FIG. 5, includes a die housing 90, an anvil member 96 and a die block 102. The anvil member 96 includes an anvil 95, a pair of arms 121, a depending leg 98 and an elliptical opening 100. The anvil member is positioned on the face 92 of the housing. The depending leg 98 is aligned in the slot 94 that is defined by means of two guide blocks 97 provided in the face of 92 of the housing 90. The anvil 95 is aligned in a die slot 99 defined by two curved blocks 89. The anvil 95 is provided with a flat surface 101 at the upper end. The anvil member 96 is biased against in the face 92 of the housing by means of the movable die block 102.

In this regard, the die block 102 includes a die section 103, a depending leg 105 and a centrally located threaded aperture 104. The die block 102 is positioned in alignment with the anvil member 96 with the die section 103 abutting blocks 89 and the leg 105 aligned with slot 94. The die block 102 is retained in the housing by means of a bolt 106 that passes through the opening 91 in the housing 90, the opening 100 in the anvil 96 and is threadedly received in the threaded opening 104 in the die block. The die block 102 is biased by means of a spring 108 provided between the head 107 of the bolt 106 and the housing 90 to hold the die block 102 against the side of blocks 89 with the anvil member 96 in positioned between the die block 102 and the surface of the face 92 of the housing. It should be noted that the anvil member 96 is free to move up or down within the limits of the elliptical opening 100.

Means are provided for biasing the anvil member 96 to the upper position in the housing 90 with the upper surface of the arms 121 of the anvil member 96 bearing against the bottom surfaces 123 of the blocks 89. Such means is in the form of a spring retainer assembly 110 secured to the bottom of the housing 90 by means of a number of mounting bolts 112. The assembly 110 includes a spring retainer block 114 having a spring bore 116 and a threaded bore 118 at the lower end. A spring 120 is positioned in the bore 116 and a circular pressure pad 122 is positioned in the bore 116 on top of the spring 120. An adjustment screw 124 is screwed into the threaded opening 118 to provide an adjustable seat for the pressure pad 122. The pressure pad 122 is located in the path of travel of the leg 98 on the anvil member 96. The anvil member 96 is biased to the upper position by means of the spring 120. The upward movement of the anvil member 96 is limited by the engagement of the arms 121 with the surfaces 123 on the blocks 89. The flat upper edge 101 of the anvil 95 should normally be flush with the upper surface 93 of the housing 90.

As described more clearly hereinafter, means are provided to control the amount of downward movement of the anvil 96 during the forming and swaging operation. Such means is in the form of the adjusting screw 124 which can be adjusted to accommodate different thicknesses of material.

Figure 6:
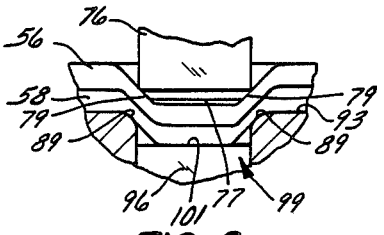
FIG. 6 is an enlarged front view of a portion of the apparatus showing the punch, die and anvil just prior to the swaging operation.
Figure 7:
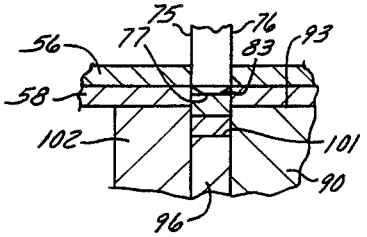
FIG. 7 is an enlarged side view of the punch, die and anvil shown in the same position at FIG. 6.
Figure 8:
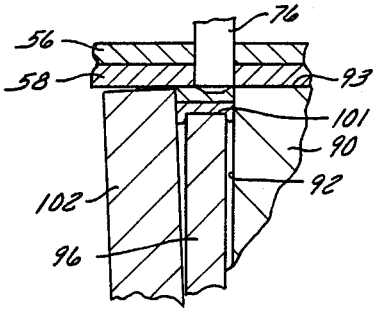
FIG. 8 is an enlarged side view of punch, die and anvil shown in FIG. 7 after swaging.

Referring to FIGS. 6, 7 and 8, the final movements of the punch and anvil are shown during the slitting, forming and swaging operation. In FIGS. 6 and 7, the flat end 77 of the punch 76 is shown in the initial forming position with the lower sheet 58 deformed into the upper slot 99 defined by the curved surfaces of blocks 89 with the upper sheet 56 just above slot 99. The flat upper surface 101 of the anvil 95 is located in abutting engagement with the bottom of sheet 58 with the pressure pad 122 resting on the adjusting screw 124. In FIG. 7, the punch 76 is shown in side elevation spaced slightly upward from the surface 93 of the housing 90. In FIG. 8, the operative end 77 of the punch 76 of the punch is shown below the upper surface 93 of the housing 90. The die block 102 will be displaced to the left due to the deformation of the formed material during the final swaging motion of the punch. This allows a portion of the deformed material to form under the edge of the bottom sheet 58 of material sufficiently to lock the sheets together. The anvil member 96 may also move slightly to the left due to the formation of a bead of material between the anvil 95 and the face 92 of the housing.

Operation

In operation, the air cylinder 22 is triggered to move the piston rod 42 upward and pivot the pivot arm 24 about the pin 26. The link 48 will bear against the clevis 52 pushing the punch member 69 downward to the position shown in FIG. 3 in one motion. The anvil member 96 will initially move downward within the limits provided by the adjusting screw 124, and will then seat on the pressure pad 122 preventing further downward movement of the anvil member. The punch will continue to move until the pressure or force required to deform the sheet material equals the force of the air cylinder. The final movement of the operative end of the punch 76 will deform the sheet material 56 and 58 slightly to the left in FIG. 8 to lock the sheets together and prevent return of the deformed material into the plane of the sheets 56 and 58.

The air cylinder is then reversed to withdraw the punch member 69 into the body of the punch cartridge. The stripping cylinder 80, which is biased downward by the spring 84, will hold the sheet material 56 and 58 against the upper surface 93 of the housing 90 until the punch 76 is pulled into the stripping section 82 thus releasing the punch member 69 from the pierced opening in the sheets 56 and 58. The stripping cylinder 80 will follow the motion of the punch on engagement of the shoulder 73 with the shoulder 81 of the stripping cylinder to provide clearance between the punch cartridge and the die cartridge for the removal of the laminated sheets 56 and 58 from the assembly. As the stripping cylinder moves up, the anvil 96 will also move upward to strip the deformed material 56 and 58 from the die slot 99.

Figure 10:
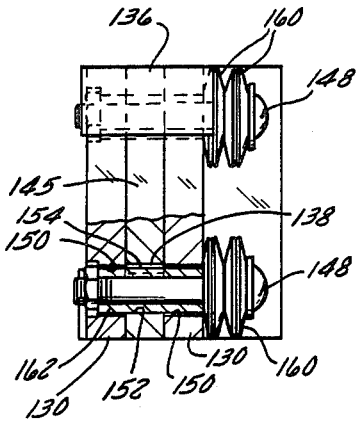
FIG. 10 is a view taken on line 10—10 of FIG. 9 showing a cross section of the alternate form of die cartridge.
Figure 11:
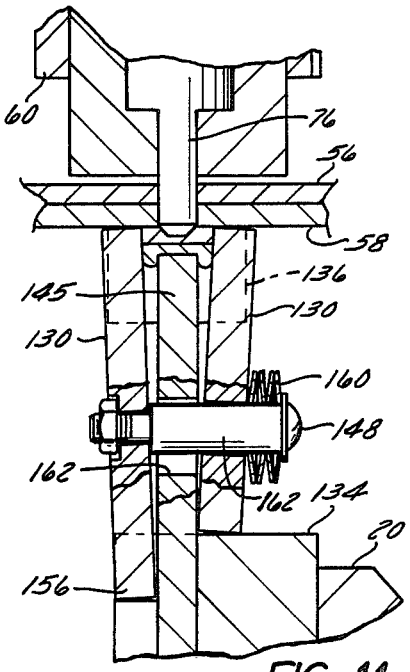
FIG. 11 is an enlarged view of a portion of FIG. 9 showing the punch at the end of the stroke.
Figure 9:
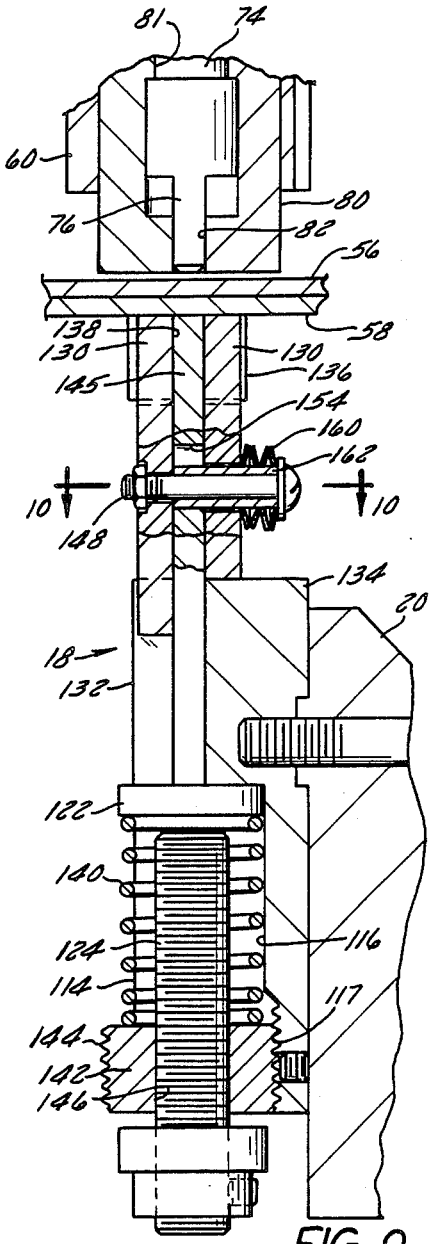
FIG. 9 is a side elevation view in section showing an alternate arrangement of the die cartridge.

Referring to FIGS. 9, 10 and 11, an alternate embodiment of the invention is shown wherein the die cartridge 18 has been modified to include two movable die blocks 130. In this regard, the housing 132 includes a base 134 having a pair of upper T-sections 136 and a die slot 138. An anvil 145 is positioned in the die slot 138 and rests on pressure pad 122 in spring retainer block 114. The block 114 includes a spring bore 116 having a threaded section 117 at the bottom and a spring 140 positioned to bias the pressure pad 122 against the bottom of the base 134. The spring 140 is retained in the bore 116 by means of a threaded ring 142 having a thread section 144 on the outer circumference and a threaded bore 146 in the center. The spring rate of spring 140 is controlled by means of the ring 142 which is turned into the threaded section 117 of the bore 116. The amount of movement of the anvil 145 is preset by the location of the end of the threaded bolt 124 with the pressure pad 122. The bolt 124 is screwed into the threaded bore 146 until the end seats on the pressure pad 122. The bolt can then be backed off the required distance for the thickness of material to be swagged.

The die blocks 130 are mounted on the T-sections 136 by means of bolts 148. In this regard, the bolts 148 pass through holes 150 in the die blocks 130 and the elliptical holes 152 in the T-sections 136. The anvil 145 is provided with a recess 154 on each side to provide room for movement with respect to the bolts 148.

The die blocks 130 each include a center section that is aligned with the anvil 145 and a pair of arms 156 that are seated on the base 134. The die blocks are biased into engagement with the T-sections 136 by means of springs 160 mounted on the bolt 148. A spacer tube 162 is provided on the bolts 148 to maintain a predetermined relation between the die blocks 130 and the springs 160.

The punch 76 and anvil 145 function in the same manner as described above. However, as seen in FIG. 12, the die blocks 130 will both move away from the anvil 145 when the punch swages the laminated material to spot clinch the swagged material on both sides of the anvil.

Although the punch and die apparatus has been disclosed as having a fixed punch cartridge with a moveable punch and a fixed die cartridge with a moveable anvil, it is within the contemplation of this application to move one or both of the cartridges. In this regard in order for the punch to be effective if the punch housing is to move, the punch must be fixed in the punch housing and project outwardly from the housing a preset distance. This can be accomplished by threading the punch member into the housing which will allow for adjustment of the section of the punch. This will not affect the stripper cylinder since it floats on the punch member.

I claim:

1. A punch and die assembly for forming a spot clinch joint between two or more laminated sheets, said assembly comprising a frame, a die cartridge mounted on said frame, said die cartridge supporting said laminated sheets and including an anvil mounted in said die cartridge, means for biasing said anvil toward said laminated sheets, adjusting means for limiting the motion of the anvil to correspond to variations in the thickness of the laminated material and moveable means on one side of said anvil for providing room for expansion of the spot clinch joint on one side of said anvil; a punch cartridge mounted on said frame in a spaced relation to said die cartridge, said punch cartridge including a punch mounted in said cartridge for reciprocal motion toward and away from said anvil; and a power source mounted on said frame and being operatively connected to move said punch through a continuous cycle of motion whereby a spot clinch joint will be formed in the laminated sheet material in each cycle of motion of the punch.

2. The assembly according to claim 1 including means in said punch cartridge for maintaining the laminated material in a fixed position during the initial movement of said punch and on the return stroke of said punch.

3. The assembly according to claim 1 including means for pushing material out of said die cartridge during the return stroke of the punch.

4. The assembly according to claim 1 including spring means for biasing said movable means toward the anvil whereby the laminated material forming the spot clinch joint will force the movable means away from the anvil to form the joint under the laminated material.

5. The assembly according to claim 1 wherein said die cartridge includes a second movable means on the other side of the anvil and means for biasing said movable means toward the anvil whereby the spot clinch joint will be formed on both sides of the anvil.

6. A punch and die assembly for forming a spot clinch joint between two or more laminated sheets, said assembly comprising a frame, a die cartridge mounted on said frame, said die cartridge including a die housing having a slitting and forming slot, a movable die block forming one side of said slot, an anvil positioned in said housing and projecting into said forming slot, means in said die cartridge for adjusting the anvil motion to the thickness of the laminated material and means positioned between said adjusting means and said anvil for biasing said anvil into said slot; a punch cartridge mounted on said frame in a spaced relation to said die cartridge, said punch cartridge including a housing and a punch mounted in said housing for reciprocal motion toward and away from said anvil; and power means mounted on said frame and being operatively connected to move said punch through a continuous cycle of motion whereby a spot clinch joint will be formed under one side of the laminated sheet material when placed in the space between said die cartridge and punch cartridge in each cycle of motion of the punch.

7. The assembly according to claim 6 wherein said moveable means includes a die block mounted on said die housing and a spring means for biasing said die block toward the anvil whereby the laminated material forming the spot clinch joint will force the die block away from the anvil upon forming the joint under the laminated material.

8. The assembly according to claim 6 wherein said die cartridge includes a second movable die block on the other side of the anvil and said biasing means being mounted to bias the die blocks toward the anvil whereby the spot clinch joint will be formed on both sides of the anvil.

9. The assembly according to claim 8 including means in said punch cartridge for stripping the laminated material from said punch on the return motion of said punch.

10. The assembly according to claim 8 including means for adjusting the bias force on said anvil.

11. A spot-clinch assembly for forming a joint in laminated sheets, said assembly comprising a frame, a die cartridge mounted on said frame, said die cartridge including a die defining a slitting and forming slot having an open side, a die block mounted for movement into engagement with said die to close the open side of said slitting and forming slot, an anvil mounted in said die for movement into and out of said slot, means biasing said anvil into said slot, means for adjusting the the amount of motion of the anvil;

a punch cartridge mounted on said frame in a spaced relation to said die cartridge, said punch cartridge including a housing, a punch mounted in said housing for movement toward said anvil;

power means mounted on said frame and being operatively connected to move said punch through a continuous cycle of motion toward and away from said anvil whereby a spot clinch joint will be formed on one side of the anvil under the laminated sheets placed in the space between said die cartridge and punch cartridge in each cycle of motion of said power source.

12. The assembly according to claim 11 including means for biasing said die block into engagement with said die, whereby said die block will be moved away from said die by the laminated material that is deformed to form the joint.

13. The assembly according to claim 12 including means in said punch cartridge for stripping said laminated material from said punch on the return stroke of said punch.

14. A punch and die assembly for forming a spot clinch joint between two or more laminated sheets, said assembly comprising a frame, a die cartridge mounted on said frame, a die having a slitting and forming slot, a die block forming one side of said slot, means for biasing said die block against said die, an anvil positioned for movement into and out of said slot, means biasing said anvil into said slot, and means for adjusting the motion of said anvil to correspond to the thickness of said laminated sheets, a punch cartridge mounted on said frame in a spaced relation to said die cartridge, said punch cartridge including a housing and a punch mounted in said housing for reciprocal motion toward and away from said anvil, and power means mounted on said frame for moving said punch continuously through one cycle of motion whereby a spot clinch joint will be formed between laminated material placed in the space between the cartridges.

15. The assembly according to claim 14 including a second moveable die block mounted on the other side of said slot and means for biasing said die blocks toward each other whereby said spot clinch joint will be formed on both sides of said anvil.

16. A punch and die assembly for forming a spot clinch joint between two or more laminated sheets, said assembly comprising a frame, a die cartridge mounted on said frame, said die cartridge including a die having a slitting and forming slot, a die block forming one side of said slot, an anvil positioned in said die and means biasing said anvil into said slot, a punch cartridge mounted on said frame in a spaced relation to said anvil cartridge, said punch cartridge including a housing, a stipping cylinder mounted for axial movement in said housing, means in said housing for biasing said cylinder toward said die cartridge and a punch mounted in said housing for movement through said cylinder into engagement with said anvil, and means mounted on said frame for moving one of said punch and anvil toward the other whereby a spot clinch joint will be formed between laminated material placed in the space between said cartridges.

17. The punch and die assembly according to claim 16 wherein said power means is connected to move both the die cartridge and punch cartridge towards each other.

* * * * *